US005127579A

United States Patent [19]

Tempelman

[11] Patent Number: 5,127,579

[45] Date of Patent: Jul. 7, 1992

[54] LOW PROPELLANT AEROSOL SPRAY HEAD

[75] Inventor: Antonie P. Tempelman, Meeden, Netherlands

[73] Assignee: Mobacc B. V., Veendam, Netherlands

[21] Appl. No.: 609,896

[22] Filed: Nov. 6, 1990

[51] Int. Cl.[5] ..... B65D 83/36

[52] U.S. Cl. ..... 239/337; 239/570; 222/149

[58] Field of Search ..... 222/148, 149, 394, 402.1, 222/402.24, 402.12; 239/113, 117, 337, 464, 473, 492, 497, 533.1, 399, 570

[56] References Cited

U.S. PATENT DOCUMENTS

| | | | |
|---|---|---|---|
| 2,629,401 | 2/1953 | Miller | 137/657 |
| 2,793,794 | 5/1957 | Samuel | 222/394 |
| 2,904,229 | 9/1959 | Samuel | 222/394 |
| 2,968,428 | 1/1961 | Samuel | 222/394 |
| 3,018,023 | 1/1962 | Talarico | 222/394 |
| 3,212,751 | 10/1965 | Hassa | 251/65 |
| 3,361,301 | 1/1968 | Meshberg | 222/149 |
| 3,447,551 | 6/1969 | Braun | 137/43 |
| 3,545,682 | 12/1970 | Beard | 239/469 |
| 3,584,789 | 6/1971 | Traynor | 239/117 |
| 3,733,013 | 5/1973 | Doyle | 222/402 |
| 3,893,596 | 7/1975 | Beres et al. | 222/402.19 |
| 3,983,890 | 10/1976 | Rogers, Jr. | 137/38 |
| 3,990,640 | 11/1976 | Laauwe | 239/533 |
| 4,182,496 | 1/1980 | Burke | 239/492 |
| 4,261,485 | 4/1981 | Borg | 222/500 |
| 4,300,489 | 11/1981 | Perrin | 123/73 |
| 4,572,406 | 2/1986 | Pratt et al. | 222/39 |
| 4,650,094 | 3/1987 | Werding | 222/55 |
| 4,662,271 | 5/1987 | Woltermann | 99/299 |
| 4,723,692 | 2/1988 | Meuresch et al. | 222/402.19 |
| 4,723,725 | 2/1988 | Comment | 239/533.1 |
| 4,957,239 | 9/1990 | Tempelman | 239/117 |

FOREIGN PATENT DOCUMENTS

| | | |
|---|---|---|
| 0043514 | 1/1982 | European Pat. Off. . |
| 2317969 | 2/1977 | France . |
| 2551828 | 3/1985 | France . |

*Primary Examiner*—Michael S. Huppert
*Assistant Examiner*—Philippe Derakshani
*Attorney, Agent, or Firm*—Weingarten, Schurgin, Gagnebin & Hayes

[57] ABSTRACT

A spray head for a fluid dispenser comprises a connecting bore for sealingly receiving a delivery tube stub of an aerosol valve; a spray orifice; a main chamber connecting the connecting bore and the orifice; a piston member disposed in the main chamber and presenting a needle member cooperating with the orifice; and a spring urging the piston member to the orifice. The orifice is sealed by the end of the needle member in an inoperative position, and the piston member is arranged to move against the force exerted by the spring under the influence of an elevated pressure prevailing in the main chamber, whereby the orifice is cleared by the needle member. To provide for an improved spray, the rear part of the piston member, together with a sealing member placed at an axial distance from the rear part of the piston member, defines a closed space through which a one-way valve is in communication with the main chamber for the injection of air from the closed space into the product stream to be sprayed through the spray orifice when the piston member moves in the direction of the sealing member.

11 Claims, 1 Drawing Sheet

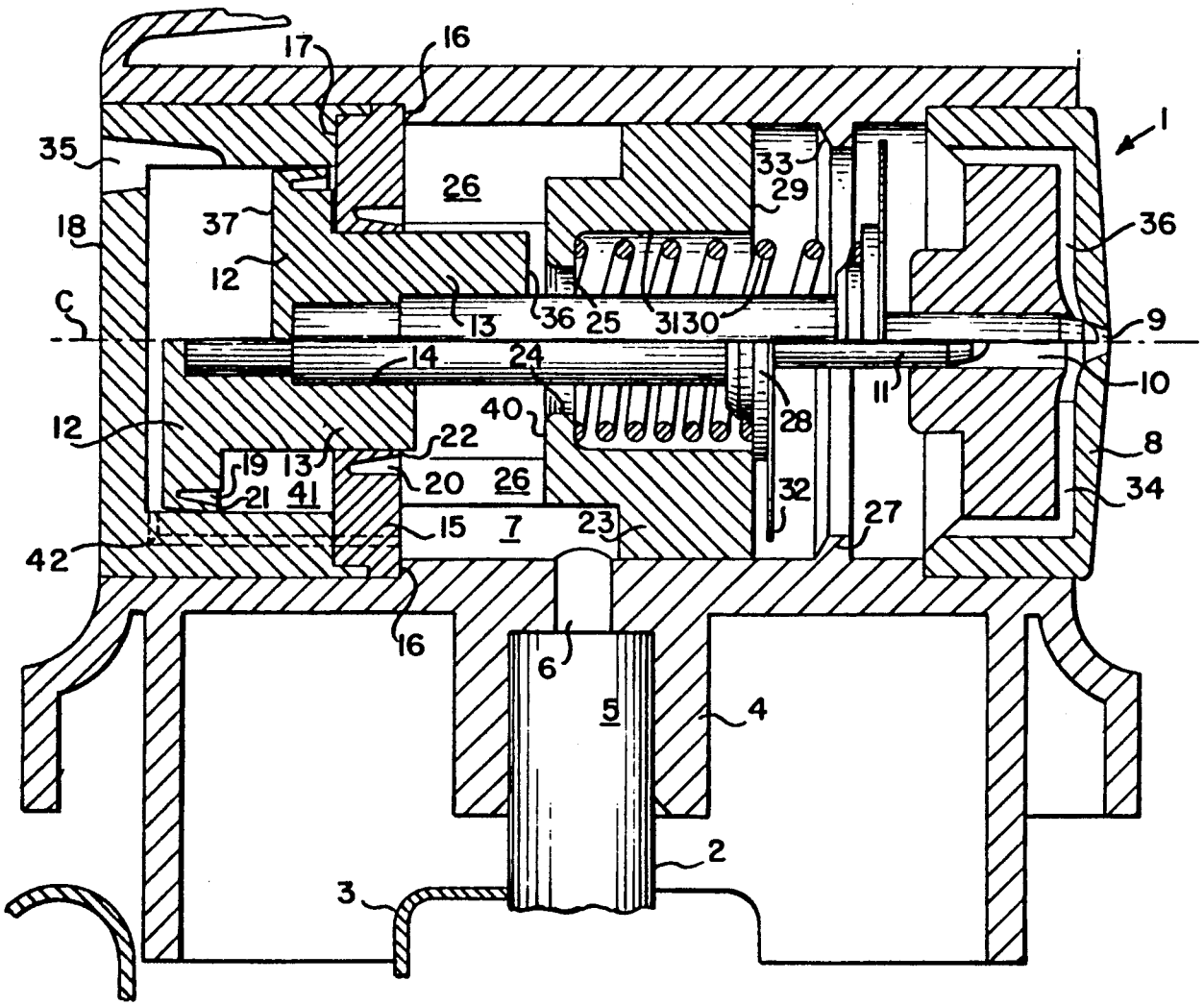
1
36
9
10
8
34
11
27
33
29
28
32
31
30
25
36
24
40
26
7
23
4
2
5
6
3
16
26
13
14
22
20
15
16
17
37
12
13
41
19
21
35
18
C
12
42

LOW PROPELLANT AEROSOL SPRAY HEAD

FIELD AND BACKGROUND OF THE INVENTION

This invention relates to a spray head for an aerosol container, comprising a connecting bore for sealingly receiving a delivery tube stub of an aerosol valve; a spray orifice; a main chamber connecting said connecting bore and said spray orifice; a piston member disposed in said main chamber and presenting a needle member cooperating with said spray orifice; and spring means urging said piston member to said spray orifice, said spray orifice being sealed by the end of said needle member in an inoperative position, and the piston member being arranged to move against the force exerted by said spring means under the influence of an elevated pressure prevailing in said main chamber, whereby the spray orifice is cleared by said needle member.

A spray head of this kind is disclosed in U.S. Pat. No. 4,182,496. Under the influence of the force exerted by the spring means on the piston member, the needle member cooperating with the spray orifice seals the spray orifice so long as the spray head is not operated. As soon as the spray head is operated with the finger, in the usual way, an open connection is formed, also in the usual way, between the interior of the container on which the spray head is mounted and the connecting duct and the chamber of the spray head. As a result, the pressure in the chamber rises and the piston member is moved away from the spray orifice against the force exerted by the spring means. The spray orifice is thus cleared by the needle member, and the product can exit from the container.

After termination of a spray operation, product residues remaining behind in the connecting duct and the chamber are effectively sealed from the outside air by the needle member cooperating with the spray orifice, and consequently cannot dry up and render the spray canister unsuitable for use. It is only between the needle member and the walls of the spray orifice that a minor quantity of product could be deposited, as a result of which the needle member could become stuck. The small contact area between the needle member and the spray orifice, however, ensures that the force exerted on the piston member when the spray head is operated is sufficiently large enough for the needle member to be pulled out of the spray orifice even then.

A spray head of this kind is particularly suitable for use in environmentally friendly low-propellant fluid dispensers such as aerosol containers. Unlike conventional aerosol containers, in low-propellant spray canisters the propellant is not permitted to leave the container. Consequently, the spray head of the dispenser must not be flushed with propellant in the usual way by holding the container upside down and operating the spray head with the finger. Indeed, in many low-propellant spray canisters, as described, for example, in U.S. Pat. No. 5,005,738, this is impossible, because means are provided to ensure that the propellant cannot exit from the container in any position the container occupies.

A problem which does occur in low-propellant spray canisters is that the spray dispensed is rather wet, which means that there is insufficient atomization. This problem can be solved to a certain extent by using a swirl chamber which is passed by the product being sprayed just before it reaches the spray orifice. Such a swirl chamber is shown in U.S. Pat. No. 4,182,496, but practice has shown that, even when a swirl chamber is used, in which the product is, so to say, mixed with gas, the resulting spray is still too wet with many products, such as paint.

SUMMARY OF THE INVENTION

It is an object of the present invention to provide a solution for the problem outlined above and to provide, generally, an effective spray head for a fluid dispenser, which is particularly suitable for low-propellant aerosol containers.

According to the present invention, for this purpose, there is provided a spray head of the kind defined above, which is characterized in that the rear part of the piston member, together with a sealing member placed at an axial distance from said rear part of the piston member, defines at least one substantially closed space which through at least one one-way valve means is in communication with the main chamber for the injection of air from said closed space into the product stream to be sprayed through said spray orifice when the piston member moves in the direction of the sealing member.

DESCRIPTION OF THE DRAWING

FIG. 1 is a side view in section of a spray head according to the invention.

DETAILED DESCRIPTION OF THE INVENTION

The single FIGURE shows a spray head 1 sealingly placed on a conventional delivery tube stub 2 of a fluid dispenser 3 such as an aerosol container containing a pressurized product. The spray head has a lower stub 4 in which a cylindrical chamber 5 has been machined. The chamber 5 receives the delivery tube stub 2 and is connected through a bore 6 in a main chamber 7 of the spray head. The main chamber 7 has a front end which in this embodiment is closed by an insert 8, which has a spray orifice 9. The spray orifice forms the outer end of a central bore 10 in the insert 8 and may be shut off or opened by the front end of a needle-shaped member 11 reaching into the central bore 10. The needle-shaped member has a tapered point and the spray orifice is also tapered, so that the point of the needle-shaped member acts like a kind of valve member cooperating with the seat formed by the tapered spray orifice.

At its rear end the needle-shaped member is provided with a piston member 12.

It is observed, that in the drawing the upper part, that is the part above centerline C, shows the needle-shaped member and the piston member in the starting position. The position of the needle-shaped member and the piston member just after pressurized product from the container 3 has been admitted to the chamber 7 by pushing in a conventional manner with a finger on the spray head, is shown below the centerline C.

The piston member 12 is T-shaped and in the drawing the T-shape is in a horizontal position. The free end of the leg 13 of the T-shaped piston member is mounted on the rear end of the needle-shaped member by means of an axial bore 14 in the leg receiving the rear end of the needle-shaped member 11. Further the leg 13 of the T-shaped piston member 12 reaches through a sealing ring 15 which is mounted between a circumferential shoulder 16 in the main chamber 7 and a front rim 17 of an insert 18, which insert closes the rear end of the main chamber 7.

The piston member 12 and the sealing ring 15 in this embodiment both are made of an elastic material, preferably a suitable plastics material, and have been provided with an annular groove 19, 20 near their sealing edges, thus providing a resilient flange 21 and 22 respectively which sealingly engages the wall of the chamber 7 and the leg 13 of the T-shaped piston member respectively.

The flanges 21, 22 function as one-way valve means which are closed if the pressure at the side of the groove is higher and which are open if the pressure at the side of the groove is lower. Of course, it would be possible to use other one-way valve means.

In the embodiment shown the piston member 12 in fact does engage the wall of the cup-shaped insert 18, which defines the rear part of the main chamber 7.

In the main chamber 7, a slide member 23 is placed in the forward part of the main chamber 7 between the bore 6 and the front insert 8. The slide member may move to and fro but at all times leaves open the bore 6. The slide member does sealingly engage the wall of the main chamber 7 and further has a central slide bore 24 through which the needle-shaped member extends. The central slide bore 24 has a larger diameter than the needle-shaped member leaving open a passage 25 between the slide member 23 and the needle-shaped member 11.

The stroke of the slide member 23 is limited at the rear by protuberances 26 which will abut against the sealing ring 15 in the rearmost position of the slide member. The forward stroke of the slide member 23 is limited by an annular shoulder 27 in the main chamber which shoulder is located at some distance behind the front insert 8.

Further the needle-shaped member 11 is provided with a disc-shaped flange 28 which is positioned in front of the slide member 23 and which can sealingly abut against the front face 29 of the slide member as shown in the lower part of the drawing. Spring means have been provided between the disc-shaped flange and the slide member, urging the slide member and the disc-shaped flange away from each other. In the embodiment shown, the spring means comprise a helical spring 30 which is received in an enlarged part 31 of the central slide bore 24 of the slide member.

The disc-shaped flange 28 carries a larger resilient disc 32 at some distance in front of the front face 29 of the slide member 23. The diameter of the disc 32 is smaller than the diameter of the main chamber 7 in that area but is a little bit larger than the inner diameter of the shoulder 27. However, because of its resiliency the disc 32 may pass by the shoulder 27 from a position rearward of the shoulder, as shown in the lower part of the drawing, to a position in front of the shoulder as shown in the upper part of the drawing. In the embodiment shown the annular shoulder has been bevelled at its rear face, as indicated by reference numeral 33.

The front part of the main chamber 7 is connected by a number of channels 34 in the front insert 8 to the spray orifice 9 in a conventional manner, so that pressurized product may pass from the main chamber 7 through the channels 34 and the spray orifice 9 to be sprayed in front of the spray head 1.

The rear insert 18 has a bore or channel 35 through which the rear part of the main chamber 7 is connected with the exterior. Said channel 35 extends at least partly in the circumferential wall of the chamber 7, or, in this embodiment of the cup-shaped insert 18, and debouches in front of the piston 12 if said piston is in its rearmost position. Thus in the rearmost position of the piston 12 air from the exterior will enter the rear part of the main chamber 7, which is then confined between the front face of the piston 12, the rear face of the sealing ring 15 and the inner surface of the circumferential wall of the cup-shaped insert 18.

The spray head described above will function in the manner disclosed hereunder.

If the spray head is pushed by the finger of a user in a conventional manner a not shown valve in the container 3 will be opened and pressurized product will flow through the delivery tube stub 2 into the main chamber 7, the various movable elements in the main chamber at that moment are positioned as shown above centerline C. As the gas pressure will be the same at both sides of the slide member 23 and at both sides of the disc 32 said elements will not move. The T-shaped piston 12, 13 however will move to the left because the pressure at the front face 36 of the leg 13 will be larger than the atmospheric pressure behind the rear face 37 of said piston.

When moving to the left the piston 12, 13 will take along the needle-shaped member 11 thereby pulling the disc 32 over the shoulder 27 and also compression spring 30. Spring 30 will be compressed because slide member 23 rests with its protuberances 26 against sealing ring 15 and cannot move to the left. Just before rear face 37 of piston 12 abuts the rear insert 18 the disc-shaped flange 28 of the needle-shaped member 11 is pulled against the front face 29 of the slide member 23, so that the front part of the main chamber 7 no longer is in open connection with the remainder of the main chamber. This situation has been shown below centerline C.

Now an overpressure will build up in the main chamber acting at the rear on the face 36 of piston 12, 13 and at the front on the rear face 40 of the slide member and on the disc-shaped flange 28. As the surfaces of the rear face 40 of the slide member 23 and the disc-shaped flange 28 together are larger than the front face 36 of the piston 12, 13, the largest force will act upon the slide member 23 and the disc-shaped flange 28 and said elements, then acting as a single piston, will move to the right, thereby pulling the piston 12, 13 along. Thereby, the piston 12, 13 will cut off the connection between the exterior and the rear part 41 of the main chamber 7 between said piston 12 and the sealing ring 15. Resilient flange 21 will flare outward and sealingly engage the inner surface of the circumferential wall of the rear part of the main chamber, but the resilient flange 22 of the sealing ring 15 will give way, so that air present in chamber 41 will be forced past resilient flange 22 to be injected into the part of main chamber 7 in front of sealing ring 15, as long as piston 12, 13 moves to the right.

Slide member 23 reaches annular shoulder 27 at substantially the same moment (or fractionally later) at which disc 32 engages the bevelled face of the annular shoulder. Then a seal exists between the disc 32 and the annular shoulder 27. Due to its resiliency and because of the pressure acting on the disc 28 and the pressure of spring 30, the disc will deform to a certain extent, thereby moving slightly further to the right. As the slide member is blocked by the annular shoulder the sealing engagement between disc 28 and front face 29 of the slide member will be broken. Then the pressure of the pressurized product in the main chamber will act upon the whole of the rather large surface of the disc-shaped flange 28 and the disc 32. The resulting large force acting from the left on the disc 32 will make the disc 32 snap over the shoulder 27. The pressurized product mixed with air from chamber 41 will then flow through the passage 25, around the disc 32 and through the channels 34 to the spray orifice 9. At the same time the spring 30 pushes the slide member to the left until its protuberances 26 abut against the sealing ring 15.

As soon as the needle-shaped element 11 has moved to the right to such as extent that it obturates the spray orifice the situation shown above centerline C is again reached and piston 12, 13 will again move to the left, pulling along the needle-shaped member 11 and the cycle will repeat itself as long as the spray head is operated by the finger of the user.

As may be clear from the above the needle-shaped member in use will move to and fro, thereby cyclically blocking and clearing respectively the spray orifice and at the same time the piston 12 will cyclically pump air into the pressurized product in main chamber 7. Thereby an improved atomization and a dry spray are obtained.

It is observed that various modifications of the above-described embodiments would be possible. Thus for instance the sealing member could at least partly by formed as a fixed annular shoulder of the circumferential wall of the main chamber 7 or of the rear cup-shaped insert 18. Further conventional check-valves could be used in through bores in the piston 12 and/or the sealing ring 15. Also it would be possible to provide a check-valve in the bore 35, which check-valve should be closed when the piston 12 is moving to the rear. In such a design one could use the rearward stroke of the piston 12 to inject (additional) air into the main chamber 7 for instance via a channel connecting the rear part of the main chamber behind the piston 12 with the main chamber. Such a channel should also contain a one-way valve and has been indicated with phantom lines at 42.

Such modifications are part of the present invention.

What is claimed is:

1. A spray head for an aerosol container, comprising:

a connecting bore for sealingly receiving a delivery tube stub of an aerosol valve;

a spray orifice;

a main chamber connecting said connecting bore and said spray orifice;

a piston member disposed in said main chamber and presenting a needle member cooperating with said spray orifice; and a spring means urging said piston member to said spray orifice, said spray orifice being sealed by an end of said needle member in an inoperative position, and the piston member being arranged to move against a force exerted by said spring means under the influence of an elevated pressure prevailing in said main chamber, whereby the spray orifice is cleared by said needle member;

a rear part of the piston member together with a sealing member placed at an axial distance from said rear part of the piston member defines at least one substantially closed space through which at least one one-way valve means permits communication with the main chamber for injection of air from said closed space into a product stream to be sprayed through said spray orifice when the piston member moves toward the sealing member.

2. The spray head as claimed in claim 1, characterized by a disc-shaped flange provided on the needle member and a slide member mounted in the main chamber between the disc-shaped flange and the piston member, said slide member having a central slide bore through which the needle member extends leaving free a passage for pressurized product between the needle member and the slide member, and said slide member being able to slide in the main chamber between a rearmost position defined by stop means and a foremost position defined by an annular shoulder in the main chamber, wherein said spring means are positioned between the slide member and the disc-shaped flange is provided with a resilient disc at a small distance from the slide member, said resilient disc having a diameter larger than an inner diameter of the annular shoulder but smaller than a diameter of the main chamber and being able at an elevated pressure in the main chamber to snap over the annular shoulder.

3. The spray head as claimed in claim 2, characterized in that the spring means comprise a helical spring placed around the needle member and supported between the disc-shaped flange and an end wall of a spring receiving chamber formed in the slide member.

4. The spray head as claimed in claim 2, characterized in that the annular shoulder is bevelled at a side facing the slide member.

5. The spray head as claimed in claim 1, characterized in that the piston member has a front face at the rear end of the needle member, said front face having a diameter substantially smaller than the diameter of the main chamber and extending through a sealing ring and wherein the piston member further comprises at the rear end of said front face a larger diameter rear part which sealingly engages the circumferential wall of the main chamber behind the sealing ring, wherein the at least one closed space is located between the larger diameter rear part of the piston member and the sealing ring.

6. The spray head as claimed in claim 1, characterized in that the at least one substantially closed space is connected with the exterior when the piston member is at least near its rearmost position.

7. The spray head as claimed in claim 1, characterized in that the piston member at its side facing the at least one substantially closed space and near its circumferential boundary has a groove, thereby forming a resilient flange acting as a one-way valve means.

8. The spray head as claimed in claim 1, characterized in that the sealing member has a groove near a sealing surface, thereby forming a resilient flange acting as a one-way valve means.

9. The spray head as claimed in claim 1, characterized by a second substantially closed space behind the piston member which second closed space is connected with the exterior through a one-way valve means and which second closed space is connected through a channel and a one-way valve means with the main chamber in front of the sealing member.

10. The spray head as claimed in claim 2, characterized by a cup-shaped insert at a rear end of the main chamber, said cup-shaped insert having a cylindrical wall which keeps the sealing ring in place against an annular protrusion in the main chamber.

11. The spray head as claimed in claim 10, characterized in that the stop means comprise at least one protrusion formed on a rear face of the slide member, said at least one protrusion engaging the sealing ring.

* * * * *